United States Patent [19]

Kendall et al.

[11] 4,371,273

[45] Feb. 1, 1983

[54] ELECTROCHEMICAL PRINTHEAD

[75] Inventors: Arthur H. Kendall, Franklin Lakes, N.J.; Joseph W. Mitchell, Montrose; Carlos J. Sambucetti, Croton-on-Hudson, both of N.Y.

[73] Assignee: International Business Machines Corporation, Armonk, N.Y.

[21] Appl. No.: 225,688

[22] Filed: Jan. 16, 1981

[51] Int. Cl.[3] ..... B41J 3/12; B41J 3/20

[52] U.S. Cl. ..... 400/119; 29/825; 65/139; 346/139 C; 346/157; 346/165

[58] Field of Search ..... 400/118–120; 346/139 C, 150, 153.1, 155, 157, 162–165; 101/93.04; 65/139; 29/592, 825

[56] References Cited

U.S. PATENT DOCUMENTS

| | | | |
|---|---|---|---|
| 3,971,042 | 7/1976 | Ring | 346/139 C |
| 4,092,650 | 5/1978 | Hinz | 346/155 |
| 4,101,909 | 7/1978 | Solmon et al. | 346/153.1 |
| 4,118,710 | 10/1978 | Tomita et al. | 346/153.1 |
| 4,157,554 | 6/1979 | Bahr et al. | 346/162 X |
| 4,170,779 | 10/1979 | Bahr et al. | 346/139 C |
| 4,195,937 | 4/1980 | Baran | 400/120 |
| 4,295,746 | 10/1981 | Hartmann | 400/119 |

*Primary Examiner*—Paul T. Sewell

*Attorney, Agent, or Firm*—Scully, Scott, Murphy & Presser

[57] ABSTRACT

An electrochromic printhead and a method of construction thereof in which the printhead is fabricated from an array of spaced, precisely positioned, small glass tubes. The array of glass tubes defines an array of cylindrical apertures extending through the printhead to form a printing pattern at a printing surface. Each cylindrical aperture has a conductor therein as an active electrode, which defines one dot of an array or matrix of dots possibly formed by the electrochromic printer. An additional conductor is provided as a reference electrode, such that a voltage may be applied between selected active electrodes and the reference electrode to define a particular printing pattern. Electrode wear is substantially eliminated by applying a coating of rutenium oxide crystals on each active electrode at the printing surface. In one disclosed embodiment, each active electrode is formed by a conductive coating applied along the interior surface of each cylindrical aperture. In a further disclosed embodiment, each active electrode comprises a cylindrical wire positioned within each cylindrical aperture. In yet another embodiment, each active electrode is formed by a conductive filler placed within each cylindrical aperture.

22 Claims, 10 Drawing Figures

PAGE PRINTER MODULE

ELECTROCHEMICAL PRINTHEAD

BACKGROUND OF THE INVENTION

1. Field of the Invention

The present invention relates generally to a printhead for an electrochemical printing arrangement, and more particularly pertains to an electrochemical printhead which is constructed in an improved manner by utilizing technology developed for the construction of precision arrays of glass nozzles for ink jet printers.

2. Discussion of the Prior Art

Electrochromic printing reactions, also referred to as molecular matrix printing, are well known in the art. In this technology, a superficial aqueous conductive liquid is applied to either regular or precoated paper, and the paper is later subjected to electrical pulses as it passes by an electrochromic printhead.

Numerous molecular species exist in one of two forms, (a) a colorless, leuco state, reduced and having an electron donor, and (b) a colored state, oxidized and being electron deficient. In the colored state the electrons in chromophoric groups are excited to higher orbital positions, and the energy required for the transition is derived from absorption of light. Electrochromic printing is normally accomplished by applying the colorless, leuco molecules to the paper surface, and then selectively removing electrons, in accordance with a desired printing pattern, by using an electrochemical printhead. A printed or colored dot is formed only under the electrodes of the electrochemical printhead to which actuating electrical pulses are supplied because electrons are removed only under those electrode areas. This arrangement achieves a very high print resolution as the size of each resultant printed dot is normally smaller than the cross sectional area of its printing electrode.

Generally, in electrochromic printing the printhead includes two different types of electrodes, active electrodes under which the color reactions are produced and passive electrode(s) which is an electrode(s) of the opposite polarity. The active electrodes are normally print pins of small cross sectional area formed into an array, such as a linear array, and in usage are continuously surrounded by the oxidation products of the electrochromic reaction. The passive electrode is normally constructed as one large common electrode extending along the surface of the printhead, and ideally does not result in any marking effects on the print paper. The chemical reaction at the passive electrode is one of oxygen reduction, or removal of hydrogen from the electrolyte, depending upon the reaction medium and the nature of the electrode. Different types of printheads for electrochromic printing have already been described, and include thin film devices, discrete wires in plastic holders or on etched silicon wafers, and multilayer ceramic head modules.

Ideally, printing should occur with no wearing or consumption of the electrodes because the electrodes are normally formed of a noble metal such as gold, platinum, iridium or rhodium, and the electrode reactions are designed such that the electrode surfaces act only as interfaces for electron exchange and do not participate mass-wise in the printing reaction. However, it has been found that there is electrode corrosion with most electrolyte solutions, even when the electrodes are constructed of the aforementioned noble metals or alloys thereof. This corrosion is caused by the relatively high electrical field between the electrodes (of the order of 300 volts per centimeter) and the relatively high current density (approximately 100 amps per square centimeter) and also because of the formation of chemical complexes between the electrodes and the electrolyte materials. It has been empirically established that mechanical wear, caused by friction between the electrodes and paper, is generally a negligible factor.

Hoffman et al. U.S. Pat. No. 4,019,886 is particularly pertinent to complement the disclosure of the present invention as this patent discloses a method of manufacturing multiple nozzle wafers for use in inkjet printing. In summary, the approach disclosed therein machines ceramic or glass blocks to form two plates of a desired smoothness and dimension, preferably in rectangular form. In a preferred embodiment a single groove is formed the length of one side of the first plate, and cross-slots, deeper than the groove, are formed the width of the same side and intersecting the groove. Slots corresponding to the cross-slots in the first plate are formed the width of one side of the second plate. The groove holds a plurality of glass tubes which may be positioned before or after the two plates are joined. Each slot holds a sealant, such as glass cane, which is entered after the two plates are joined.

The joined plates with tubes and glass cane are then spring clamped in an upright position on a support, and this entire assembly is then exposed to a temperature which is sufficient to melt only the glass cane, which flows by capillary and gravity action, through the groove to provide a complete seal for the tubes, specifically in the area between the cross-slots. After the sealing operation has been completed, the joined plates are gradually cooled and then the area between the slots is sliced into thin nozzle wafers. After one side of the cut wafer undergoes lapping and polishing operations, it is ready for mounting on a back-up plate using techniques such as epoxy bonding, glass sealing or soldering. After mounting, the front side of the wafer is lapped and polished. The wafer thus mounted on the back-up plate is ready for connection to a source of high-pressure fluid.

Although the disclosure of this patent is directed to the construction of wafers for use in ink jet printers, in accordance with the teachings of the present invention the thusly formed wafers may also be utilized for the construction of electrochromic printers.

Bahr et al. U.S. Pat. No. 4,157,554 discloses a multiple electrode printhead for a metal paper printer wherein a printhead body of plastic or glass contains a plurality of closely spaced glass tubes. The glass tubes provide low friction passageways for fine wire electrodes which extend therethrough protruding beyond the printhead body to provide a flexible contact with the metal layer of a recording medium. A pair of feed rolls frictionally engage the individual wires such that when the feed rolls are operated they can adjust the position of the wires to compensate for wear of the ends thereof in contact with the metal layer.

Accordingly, in this arrangement the individual electrode wires are longitudinally movable through the printhead to provide adjustment to compensate for electrode wear. The type of printer and the printing technology are completely different from those of the present invention which utilizes sealed active electrodes in an electrochromic printing operation.

SUMMARY OF THE INVENTION

Accordingly, it is a primary object of the present invention to provide an improved electrochemical printhead and a method of construction thereof which results in improved print quality, improved resolution of the print, and substantial elimination of electrode wear in the printhead.

A further object of the subject invention is the provision of an electrochemical printhead which is readily fabricated by the use of known technologies, particularly those developed for ink jet printers.

An additional object herein is the provision of an electrochemical printhead having a substantial number of active electrodes precisely positioned along a linear array wherein the individual tolerances of each electrode and the cumulative tolerances along the array are readily maintained within acceptable limits.

In accordance with several different embodiments disclosed herein, the present invention provides an electrochemical printhead having a housing which has an array of spaced, precisely positioned, small cylindrical apertures or cavities extending therethrough to define a printing pattern along a printing surface substantially perpendicular to the longitudinal axes of the apertures. Each cylindrical aperture has a conductor therein forming an active electrode which defines one dot of an array or matrix of dots possibly formed by the electrochemical printer. At least one additional conductor is provided for a reference electrode such that a voltage may be applied between selected active electrodes and the reference electrode to define a particular printing pattern.

In one disclosed embodiment of the present invention, each active electrode is formed by a conductive coating applied along the interior surface of each cylindrical aperture. In a further disclosed embodiment of the subject invention, each active electrode comprises a cylindrical wire positioned within each cylindrical aperture. In yet another embodiment, each active electrode is formed by a conductive filler placed within each cylindrical aperture.

In accordance with the teachings of several disclosed embodiments of the present invention, the printhead housing is constructed from an array of small hollow glass tubes positioned side by side relative to each other. In these embodiments, the reference electrode may be a conductive coating applied to the exterior surface of each glass tube, which results in a printing head having improved print quality and resolution. Alternatively, the reference electrode may be a conductive filler placed around the hollow glass tubes, or in some variations the reference electrode can be a common ground electrode extending along the electrochemical printing head.

Furthermore, in accordance with the teachings herein the printhead housing may be constructed in a glass, ceramic, silicon or equivalent substrate having the array of small hollow glass tubes placed therein.

The present invention combines technology developed for the construction of precision arrays of glass nozzles for an ink jet printer with electrochemical printing technology. In accordance with the teachings herein, the precision holes or cavities for a glass capillary nozzle array previously developed for ink jet printer are utilized as sites for conductor wires or for conductive coatings or conductive fillers.

The teachings of the present invention provide advantages in the areas of improvements in print quality, improvements in resolution, and also substantial elimination of electrode wear.

Electrode wear is substantially eliminated by applying a coating of ruthenium oxide crystals on each active electrode at the printing surface to substantially eliminate electrode wear in the printhead. The coating is preferably a suspension of ruthenium oxide crystals which are less than one micron in size held in suspension by an epoxy binder, or some other binder such as fritted glass, fired together with $RuO_2$ crystals.

BRIEF DESCRIPTION OF THE DRAWINGS

The foregoing objects and advantages of the present invention for an electrochemical printhead may be more readily understood by one skilled in the art with reference being had to the following detailed description of several preferred embodiments thereof, taken in conjunction with the accompanying drawings wherein like elements are designated by identical reference numerals throughout the several drawings, and in which.

DETAILED DESCRIPTION OF THE INVENTION

Figure 1:
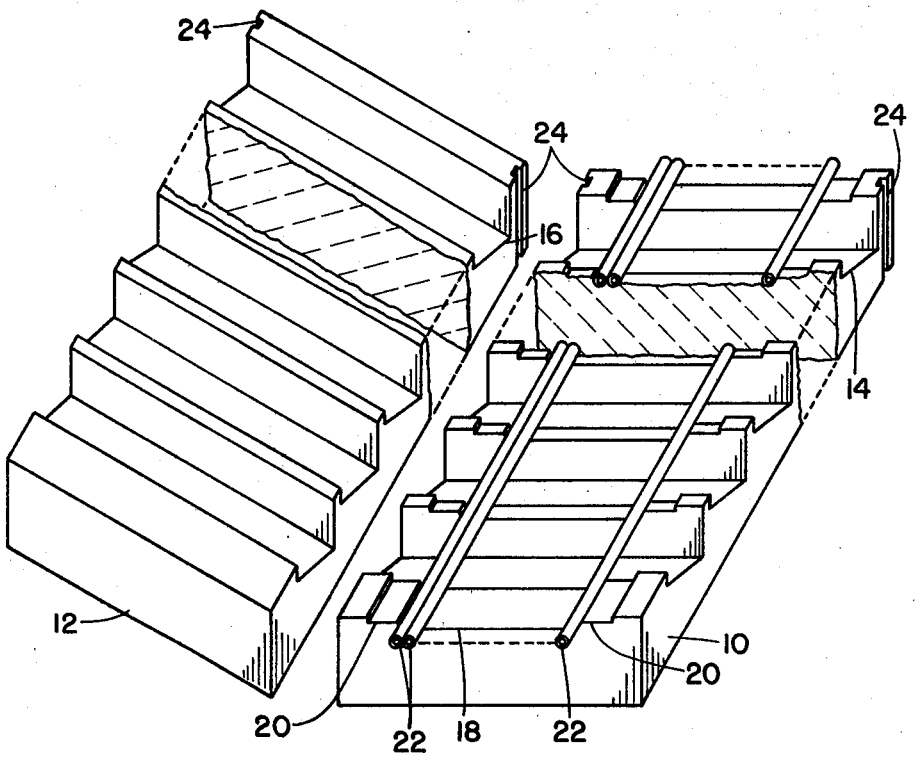
FIG. 1 is a perspective illustration of two complementary plates adapted to precisely position a plurality of capillary glass tubes relative to each other for fabrication of an electrochemical printhead pursuant to the teachings herein.

Referring to the drawings in detail, FIG. 1 illustrates a preferred embodiment of a plate assembly for the fabrication of multiple glass capillary arrays. Plates 10 and 12, preferably of the same material such as glass or ceramic and surface area, are machined to provide parallel, deep, trapezoidal-type slots 14 and 16 along one surface thereof. Plate 10 is a further machined to provide a single wide groove 18 and smaller grooves 20. Groove 18 is sufficiently wide to permit a plurality of glass capillary elements 22, preferably glass tubes, to be placed snugly side by side across the entire length of the groove surface. Groove 18 may also be slightly tapered in the corners or have undercuts in the inside corners. The smaller grooves 20 may take any dimension to assure a flow of glass between the plates to guarantee a bond between plates 10 and 12. Grooves 24 provide for alignment of the plates when assembled.

Figure 3:
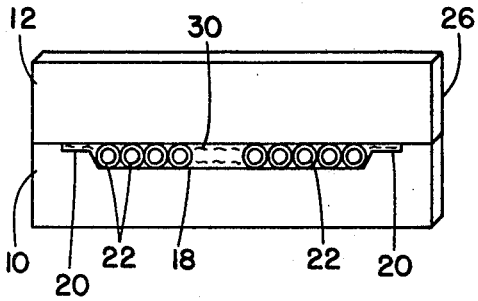
FIG. 3 illustrates a printhead wafer produced by the assembly process of FIGS. 1 and 2.

The plates 10 and 12 are joined to form a plate assembly wherein slots 14 and 16 are perfectly aligned by a wire placed in groove 24. The wire is made of heat resistant material, e.g., tungsten. Such alignment is necessary since the area between each adjacent pair of slots is later cut to form multiple wafers, one of which 26 is illustrated in FIG. 3. At this time the plates are joined, but not sealed, and the tubes 22 rest loosely in groove 18.

Figure 2:
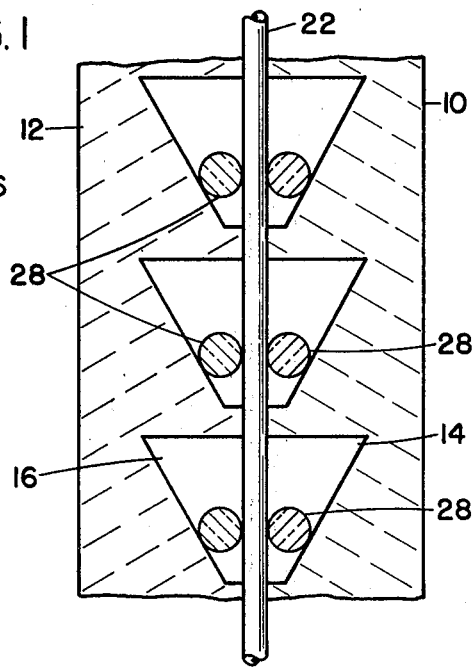
FIG. 2 illustrates an elevational sectional view of the assembled components of FIG. 1 at an intermediate stage in the fabrication process of an electrochemical printhead.

FIG. 2 shows a partial cross sectional view of the assembly of FIG. 1. It may be seen that the trapezoidal type slots on both sides of glass capillary tubes 22 permit glass cane 28 to be inserted therein in which position they rest snugly against the glass tubes on both sides thereof and, therefore, when melted, to flow freely as shown at 30 due to capillary and gravity action, to cause a glass area between each upper slot and lower slot to seal in a void and bubble free manner.

The plate assembly is then cut after the sealing operation, wherein a plurality of wafers 26 are obtained. FIG. 3 shows a typical wafer 26 with the formed melt in grooves 18 and 20 which fully seals the tubes and provides a bond between the plates. After a wafer 26 is cut, there are performed precision lapping and polishing operations that are known, e.g., see the IBM Technical Disclosure Bulletin, Dec. 1974, Vol. 17, No. 7, p. 2171.

Moreover, in alternative embodiments, other fillers 30 besides glass may be utilized, such as epoxy filler or solder, and also a filler such as epoxy may carry conductive materials in suspension such that the filler is conductive and can function as the reference or counter electrode for the electrochemical printhead. In such cases the original glass structure would be bonded together without the use of seal glass by using a glassing cycle that would cause the tubes and substrates to bond to each other at points of contact.

Figure 4:
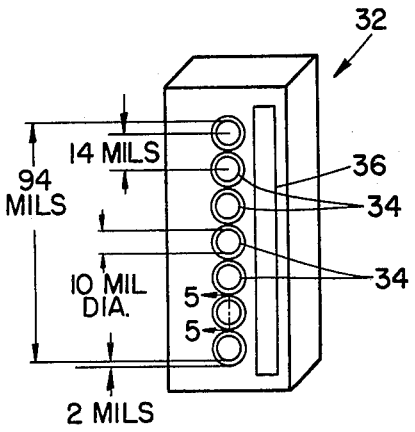
FIG. 4 is a perspective view of a first embodiment of an electrochemical printhead constructed pursuant to the teachings herein having a linear array of electrochromic active electrodes therein.

FIG. 4 illustrates on embodiment of an electrochemical printhead 32 wherein the glass capillaries have a 2 mil wall thickness and a 10 mil internal diameter bore, with the glass capillary tubes being arranged 14 mils center to center. A 10 mil diameter conductive wire 34, formed of one of the noble metals mentioned earlier in the specification such as platinum or gold is placed within each bore to form the active electrodes of the electrochemical printer. This embodiment of the present invention includes a common reference electrode 36 extending along the surface of the printhead, which may be placed fairly close (4 mils or less) to the active electrodes. The reference electrode may also be formed of one of the noble metals such as gold. In this embodiment, the area defined and extending from the top electrode to the bottom electrode of the linear array, is 94 mils long. The wires leading from the back of wafer 32 may be insulated and connected directly to circuitry for selectively actuating the electrodes in accordance with the pattern to be printed. An embodiment of the printer head as illustrated in FIG. 4 was constructed, and produced excellent dark characters, about 100 mil character size having 100 pels resolution. The characters printed thereby were very sharply defined, having no smearing of the dots. It is contemplated that electrochemical printheads similar to FIG. 4 could be fabricated with many different dimensions, such as for example wherein the glass tubes have a 1.5 mil wall thickness with an internal bore diameter varying from 1 to 10 mils.

In some variations of the invention spacing between the inner glass wall and the metal conductor encased therein may be prevented by drawing the glass capillaries with the metal inside thereof. In this variation, illustrated in FIG. 5, a perfect seal is achieved between the glass capillary tube and the encased active electrode. This embodiment would effectively prevent any problems with electrochemical solution flowing, as by capillary action, in the annular gap between the glass tube and the encased conductor.

Figure 6:
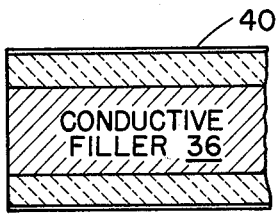
FIG. 6 illustrates a sectional view similar to that of FIG. 5, but wherein the active electrode is formed by a conductive filler placed within each cylindrical aperture.

FIG. 6 illustrates a further embodiment of the present invention wherein the active electrode for each printing element is formed by filling each glass capillary tube with a conductive filler 26 rather than by a separate wire within each capillary tube. An embodiment of this nature is preferred as it avoids any problems with clearance and tolerance associated with the placement of each wire within each capillary tube. Commercially available wires are not perfectly round, do not have uniform diameters, and also in many instances do not have smooth surfaces. The conductive filler may be any suitable type of filler such as an epoxy binder carrying a conductive material in suspension such as an $RuO_2$ paste described in greater detail below, or may be other suitable conductive filler which hardens in place after being introduced into the glass capillaries.

Figure 7:
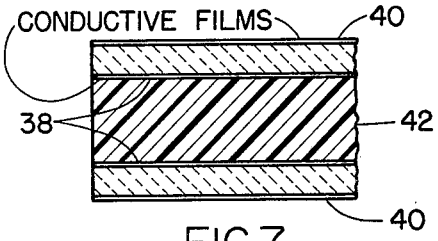
FIG. 7 is a sectional view similar to those of FIGS. 5 and 6, but wherein the active electrode is formed by a conductive film formed on the inner surface of each cylindrical aperture.

FIG. 7 illustrates a further embodiment of the present invention wherein each active electrode is formed by a conductive coating 38 applied to the interior surface of each glass capillary tube. This embodiment of the present invention may also have the exterior surface of each glass capillary tube coated with a conductive film 40 which then can be utilized as the counter or reference electrode for the active electrode within the glass tube, thereby providing each individual active electrode with a separate reference electrode. An embodiment of this nature improves printing quality even further because of the optimized distribution of the printing current around each individual active electrode. Moreover it offers additional advantages in both simplicity and configuration.

The following method may be used to coat the surface of each glass capillary tube with a conductive film. An electrodeless gold layer is deposited on the surface of each glass capillary tube. A second layer of electroplated gold is then applied over the electrodeless coating of gold. The glass capillary tubes are then fired or heated at an elevated temperature to ensure diffusion of the metal into the glass and ensure optimum adhesion and metallization thereof. The metallized glass capillary tubes are then utilized to construct a printhead in the manner illustrated in FIGS. 1 through 3 herein. It is contemplated that the aforesaid coating steps may be carried out either before or after drawing of the capillary tubes. A unique and advantageous feature of this arrangement is that when the coated glass capillary tubes are subjected to the construction process described with reference to FIGS. 1 through 3, and the filler glass canes are melted, the melted glass flows by capillary action around each coated metal electrode to such an intimate degree that it insulates the exterior coated surface of each glass capillary tube from the exterior surface of each adjacent glass capillary tube. During operation of an electrochemical printhead constructed in this manner, each active electrode is actuated with a voltage of approximately 15 volts and draws approximately 3 milliamps in current, such that the electrical power is sufficiently low that crosstalk between adjacent electrodes is avoided.

Figure 5:
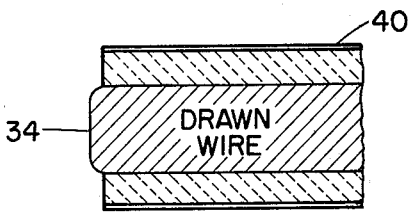
FIG. 5 illustrates a sectional view taken along line 5—5 in FIG. 4, and shows further details of the construction of each active electrode.

The conductive coatings may be of any suitable material, for instance copper or a precious metal such as silver, gold or platinum, which is applied to the surface of each capillary tube and then diffused therein as described. Moreover, after the conductive coating has been applied to the inner surface of each capillary tube, the remainder of the tube may be filled with a dielectric 42 as illustrated in FIG. 7. The teachings of the embodiment of FIG. 7 are also applicable to the other disclosed embodiments, particularly with respect to the coating of the counter electrode on the exterior surface of each capillary tube, and coatings 40 are shown in FIGS. 5, 6 and 8 to illustrate this feature.

Figure 9:
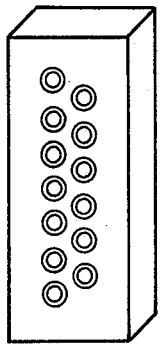
FIG. 9 is a perspective view of an electrochemical printhead, similar to that illustrated in FIG. 1, but wherein a two dimensional array of active electrodes are provided to provide improved print quality and resolution.

FIG. 9 illustrates a further embodiment of an electrochemical printhead constructed pursuant to the teachings of the present invention wherein the print quality and resolution are further improved, while maintaining the same character size. In this embodiment, the size of the central bore of each capillary tube is reduced to a 5 mil diameter, arranged in a 14 mil center to center linear array, similar to the embodiment of FIG. 4, but wherein two adjacent rows of electrodes are formed into a two dimensional array of electrodes. The two dimensional array has seven elements in the first row and six elements in the second row, with the second row electrodes being staggered with respect to the electrodes of the first row. This embodiment of the present invention may be constructed pursuant to any of the various teachniques described above. The first row of electrodes are utilized to create a selective print pattern on the print paper, and the paper is then moved incrementally to the right such that the dot pattern obtained from the first printing operation is now arranged under and between the electrodes in the second row, whereupon the electrodes in the second row are selectively energized to provide further definition of the print pattern. This arrangement provides improved print quality as well as increased resolution (200 pels in this embodiment) while maintaining the same character size.

Figure 8:
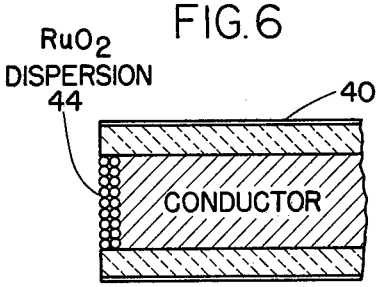
FIG. 8 shows a sectional view, similar to those of FIGS. 5–7, also illustrating a ruthenium despersion layer applied to the end of the active electrode to prevent wear thereof.

FIG. 8 illustrates a further embodiment of the present invention wherein a coating of a metal oxide dispersed material, such as ruthenium oxide, is applied to each active electrode at the printing surface to substantially eliminate electrode wear of the printhead. Ruthenium oxide ($RuO_2$) electrodes are effective in preventing electrode wear in electrode chemical printheads. However, the application of a thin film or layer of this material to the electrode surface has presented associated problems, particularly since the properties of the $RuO_2$ film may not be the same as those of bulk $RuO_2$ material. Moreover there are problems associated with adhesion, pin holes, and synthesis of an $RuO_2$ film at the surface of the active electrode pins. For the aforementioned reasons, the utilization of bulk $RuO_2$ as the surface material for the active electrode print pins could be of significant importance.

An electrochemical printhead of this type can be obtained by the following method of construction. Crystals of pure $RuO_2$ bulk material are ground to 0.1 to 1 micron size particles. A paste of suitable consistency is formed by mixing the $RuO_2$ powder particles with epoxy or some other organic matrix, thereby yielding a conductive mixture (due to the small particle size, the crystals provide conductive paths within the semifluid). The paste mixture is then utilized to fill and cover the print area of the electrochemical printhead. In embodiments constructed in this manner, the pure $RuO_2$ material is used for the electron exchange in the printing reaction, and behaves as bulk $RuO_2$, producing essentially no electrochemical wear and a resultant long operating life for the printhead. In these embodiments the metal electrode, whether it be a wire or a conductive paste filler as described above, can be etched or partially removed, as illustrated in FIG. 8, prior to the application of the $RuO_2$ film dispersion such that the resultant printhead has a flush surface as illustrated. Moreover in other embodiments the $RuO_2$ coatings can be applied by utilizing sputtering or evaporation technologies.

Figure 10:
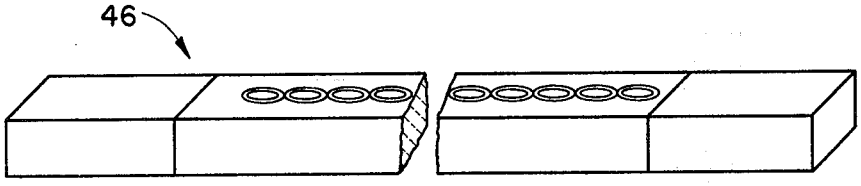
FIG. 10 is a perspective view of a page or line printer constructed pursuant to the teachings herein.

The teachings of the present invention for electrochemical printheads may also be applied to a line or page printer 46 because arrays of printing electrodes (containing 200 or more separate electrodes and extending to eight inches) can be readily constructed in a manner as illustrated in FIG. 10 which is a broken view of such an embodiment. In an embodiment of this nature, the rear surface of the printhead may be used to support leads extending to the individual electrodes, formed for example with photolithographic techniques. Land patterns can be placed around the individual electrodes, and conductive lines can be printed and expanded to pads for ultrasonic bonding with external cables, in much the same manner as in semiconductor or printed circuit applications. An embodiment of this nature would make each electrode individually addressable in a convenient manner. Moreover, multilayer or multiplane structures, with VIA hole connectors, may also be utilized in some embodiments.

In the construction of a page or line printer from individual glass capillary tubes, as illustrated in FIG. 10, the cumulative tolerances of the individual capillary tubes along the line, which may consist of several hundred tubes, is a matter of concern. This concern may be minimized by statistically mixing individual tubes produced in a manner as is known in the art to statistically minimize accumulated errors along the linear array.

Although the embodiments described thus far have been described in the context of construction with glass capillary tubes in a glass substrate, other embodiments pursuant to the teachings herein can be constructed from a ceramic or silicon substrate in which the individual bores for each active electrode are formed, for instance, by etching. The cavities thus created would then be selectively filled with a suitable active electrode or electrode material, as described above, and the embodiments shown in FIGS. 4, 9 and 10 are illustrative of the type of electrochromic printheads which may be constructed in this fashion. In embodiments constructed with a silicon substrate, the silicon may be doped to form a p type semiconductor or conductor, or doped to form an n type dielectric substrate.

While several embodiments and variations thereof have been described in detail herein, it should be apparent that the teachings and disclosure of the present invention on electrochemical printheads will suggest many other embodiments and variations to those skilled in this art.

What is claimed is:

1. An electrochromic printhead for an elecctrochromic printing arrangement in which electrical pulses are selectively applied to active electrodes spaced in a printing array while a paper coated with a superficial aqueous conductive liquid is passed therebeneath, comprising:

a. a printhead housing having an array of spaced, precisely positioned, small cylindrical apertures therethrough fabricated from an array of small hollow glass tubes positioned side by side relative to each other, to define a printing array along a printing surface of the printhead housing extending substantially perpendicular to the cylindrical axes of said apertures;

b. each cylindrical aperture having a conductor therein forming one active electrode for actuation of the electrochemical printer, each conductor being sealed relative to its cylindrical aperture in the hollow glass tube such that the superficial aqueous conductive liquid is prevented from flowing or entering therein; and c. at least one additional conductor, defining a reference electrode, extending to said printing surface, whereby a voltage may be applied between selected active electrodes and said at least one reference electrode to define a printing pattern at said surface.

2. An electrochemical printhead as claimed in claim 1, each active electrode being a conductive coating applied along the interior surface of each cylindrical aperture.

3. An electrochemical printhead as claimed in claim 1, each active electrode being a cylindrical wire conductor positioned within each cylindrical aperture.

4. An electrochemical printhead as claimed in claim 1, each active electrode being a conductive filler placed within each cylindrical aperture.

5. An electrochemical printhead as claimed in claim 1 or 2 or 3 or 4, said at least one additional conductor being a conductive coating applied along the exterior surface of each hollow glass tube.

6. An electrochemical printhead as claimed in claim 1 or 2 or 3 or 4, said at least one additional conductor being a conductive filler placed around said hollow glass tubes.

7. An electrochemical printhead as claimed in claim 1 or 2 or 3 or 4, said at least one additional conductor being a common reference electrode extending along said surface of the printing array.

8. An electrochemical printhead as claimed in claim 1 or 2 or 3 or 4, including a coating of metal oxide crystals on each active electrode at said surface to substantially eliminate electrode wear in the printhead.

9. An electrochemical printhead as claimed in claim 8, said metal oxide comprising ruthenium oxide.

10. An electrochemical printhead as claimed in claim 9, said coating being a suspension of ruthenium oxide crystals which are less than one micron in size.

11. An electrochemical printhead as claimed in claim 10, said coating including an epoxy binder.

12. A method of fabricating an electrochromic printhead used in an electrochromic printing method in which electrical pulses are selectively applied to active electrodes spaced in a printing array while a paper coated with a superficial aqueous conductive liquid is passed therebeneath, comprising:

a. forming a printhead housing with an array of spaced, precisely positioned, small cylindrical apertures therethrough from an array of small hollow glass tubes positioned side by side relative to each other, to define a printing array along a printing surface of the printhead housing extending substantially perpendicular to the cylindrical axes of said apertures;

b. placing a conductor within each cylindrical aperture with the conductor being sealed relative to its cylindrical aperture to form one active electrode for actuation of the electrochemical printer, with the sealed conductor in the cylindrical aperture preventing the superficial aqueous conductive liquid from entering therein; and c. placing at least one additional conductor, defining a reference electrode, at said printing surface, whereby a voltage may be applied between selected active electrodes and said at least one reference electrode to define a printing pattern at said surface.

13. A method of fabricating an electrochemical printhead as claimed in claim 12, said step of placing a conductor within each aperture comprising applying a conductive coating along the interior surface of each cylindrical aperture.

14. A method of fabricating an electrochemical printhead as claimed in claim 12, said step of placing a conductor within each aperture comprising placing a cylindrical wire conductor within each cylindrical aperture.

15. A method of fabricating an electrochemical printhead as claimed in claim 12, said step of placing a conductor within each aperture comprising placing a conductive filler within each cylindrical aperture.

16. A method of fabricating an electrochemical printhead as claimed in claim 12 or 13 or 14 or 15, said step of placing at least one additional conductor comprising the step of applying a conductive coating along the exterior surface of each hollow glass tube.

17. A method of fabricating an electrochemical printhead as claimed in claim 12 or 13 or 14 or 15, said step of placing at least one additional conductor comprising the step of placing a conductive filler around the hollow glass tubes.

18. A method of fabricating an electrochemical printhead as claimed in claim 12 or 13 or 14 or 15, said step of placing at least one additional conductor comprising the step of forming a common reference electrode extending along said surface of the printing array.

19. A method of fabricating an electrochemical printhead as claimed in claim 12 or 13 or 14 or 15, including the step of coating metal oxide crystals on each active electrode at said surface to substantially eliminate electrode wear in the printhead.

20. A method of fabricating an electrochemical printhead as claimed in claim 19, said metal oxide comprising ruthenium oxide.

21. A method of fabricating an electrochemical printhead as claimed in claim 20, said coating being a suspension of ruthenium oxide crystals which are less than one micron in size.

22. A method of fabricating an electrochemical printhead as claimed in claim 21, said coating including an epoxy binder.

* * * * *